US006152015A

United States Patent [19]

Migliori

[11] Patent Number: 6,152,015

[45] Date of Patent: Nov. 28, 2000

[54] ONE-SIDE FED, DOUBLE-ACTING, PNEUMATIC ACTUATOR

[76] Inventor: Luciano Migliori, Via F.lli Cervi, Residenza del Sagittario, 29/1 20090 Milano 2, Segrate, Italy

[21] Appl. No.: 09/141,747

[22] Filed: Aug. 28, 1998

[30] Foreign Application Priority Data

Sep. 23, 1997 [IT] Italy ..... MI97A2149

[51] Int. Cl.[7] ..... F01B 7/20

[52] U.S. Cl. ..... 92/52; 92/177

[58] Field of Search ..... 92/52, 165 PR, 92/177

[56] References Cited

U.S. PATENT DOCUMENTS

| | | | |
|---|---|---|---|
| 3,920,084 | 11/1975 | Russell, Jr. | 173/79 |
| 4,080,877 | 3/1978 | DeFries | 92/61 |
| 4,567,811 | 2/1986 | Piegza et al. | 91/169 |
| 4,928,577 | 5/1990 | Stoll | 92/177 |
| 5,322,004 | 6/1994 | Sims | 92/52 |

FOREIGN PATENT DOCUMENTS 0 692 639 1/1996 European Pat. Off. .

*Primary Examiner*—Edward K. Look
*Assistant Examiner*—Thomas E. Lazo
*Attorney, Agent, or Firm*—Young & Thompson

[57] ABSTRACT

The pneumatic actuator comprises at least one double-acting cylinder having a tubular body and two closure heads which define a piston chamber for a reciprocable piston; the body of the cylinder consists of an extruded tubular section provided with at least one longitudinal conduit for the air flow, which extends in a wall between the two end portions of the tubular body. One of the closure heads at an end side of the tubular body is provided with air-flow passage for connecting one end of the piston chamber via said longitudinal conduit to an air inlet/outlet opening close to the other end side of the body. The second closure head of the cylinder is in turn provided with an air inlet/outlet opening connected to the end of the piston chamber which is opposite the previous one. The actuator is made in the form of a single cylinder or of a telescopically extending cylinder having several stages.

12 Claims, 6 Drawing Sheets

ONE-SIDE FED, DOUBLE-ACTING, PNEUMATIC ACTUATOR

FIELD OF THE INVENTION

The present invention relates in general to linear pneumatic actuators and in particular is aimed at the assembly of a pneumatic actuator consisting of a standard double-acting cylinder or a cartridge cylinder, or of the type comprising two or more pneumatic cylinders longitudinally sliding one in the other to form a telescopically extending pneumatic actuator.

STATE OF THE ART

Standard pneumatic or cartridge cylinders generally comprise a tubular body and two end closure heads which in the overall assembly define an elongated piston chamber wherein a drive piston slides; the piston usually is provided with a rod member tightly projecting from one of the same closure heads.

Pressurised air is selectively fed or discharged from both ends of the piston chamber, through the apertures or ports in each of the two opposite closure heads.

Pneumatic cylinders of this type are widely known and used in various areas of application.

In some cases it is necessary to feed the pressurised air at the two ends of the piston chamber from one side only of the cylinder; in this case suitable piping has to be provided, which extends between both closure heads, outside the body of the cylinder.

A similar solution, in addition to being complex in some respects in that it necessarily requires connection pipes outside of the body of the cylinders for feeding air at the piston chamber, cannot always be suitable for those applications for which the lack of space makes a similar solution difficult if not impossible to adopt. Moreover, an external arrangement of the piping for feeding the pressurized air, may entail the risk of breaks or damage to the piping itself, in this case disabling operation of the cylinder. Therefore, in terms of reliability, convenience and costs, these known solutions are not to be recommended.

Telescopic cylinders are also known and used for raising and lowering loads, for example for raising work platforms, hoists, lifts and the like.

In general these hydraulic cylinders consist of a series of single-acting hydraulic cylinders, of decreasing diameter, sliding one in the other, wherein the descent or return stroke of the cylinders simply takes place by gravity, or of the weight of the same cylinders and/or of the hoisted load.

At present double-acting and telescopically extending cylinders are not known in the pneumatics sector. This presumably depends on the difficulties encountered hitherto in finding a suitable solution for feeding the pressurised air at both ends of the piston chambers of the cylinders, for the reasons previously referred to which in this case are made more critical by the relative movement between the cylinders of the same actuator.

In the pneumatics sector there is moreover the need to provide linear actuators capable of performing relatively long working strokes, maintaining substantially reduced overall dimensions, such as to occupy the smallest space possible.

In this respect, as regards conventional pneumatic cylinders, some solutions have been proposed which are not however capable of fully meeting the requirement referred to above. For example with EP-A-Q 692 639 a compact structure of a pneumatic cylinder has been proposed, by adapting a special configuration of the tubular body and of the two end closure heads. According to this solution too, the longitudinal dimensions of the cylinder are still greater than the total working stroke which can only be increased by lengthening the body of the same cylinder.

The need therefore of providing solutions which allow for innovation of conventional constructional techniques for pneumatic cylinders, and in particular for providing double-acting pneumatic actuators which are more reliable and with small overall dimensions, is to date still unfulfilled.

OBJECTS OF THE INVENTION

Therefore the general object of the present invention is to provide a linear pneumatic actuator of the double-acting type which has a simple constructional design and limited overall dimensions compared to conventional pneumatic actuators.

A further object of the invention is to provide a pneumatic actuator as referred above, wherein the conduits for flowing the pressurized air are suitably provided in the same actuator without creating additional external bulk, that is to say without requiring additional parts or further assembly operations.

Another object of the present invention is to provide the assembly of a double-acting and telescopically extending pneumatic actuator having the features referred previously, by means of which it is possible to use cylinders having working strokes of any required length, which can be fed on one single side, or a double-acting pneumatic actuator which in the contracted condition has overall dimensions of the body smaller than the maximum working stroke which can be obtained with the same actuator.

BRIEF DESCRIPTION OF THE INVENTION

According to the present invention a pneumatic actuator has therefore been provided comprising at least one double-acting cylinder having a hollow body and two end closure heads, to define an elongated piston chamber wherein a piston slides and wherein inlet/outlet ports for selective feeding and discharging of pressurized air at both ends of the piston chamber are provided at one end side, characterised:

- in that said hollow body of the cylinder comprises a tubular section provided with at least one conduit for the flow of air, longitudinally extending between the two opposite ends of the tubular section, in at least one side wall;
- in that a first one of said closure heads is provided with flow passages for connecting one side of the piston chamber to a first air inlet/outlet port, via said longitudinal conduit to the tubular body; and
- in that the second one of said closure heads is in turn provided with flow passages for connecting the other end of the piston chamber, to a second inlet/outlet port for the pressurised air.

In accordance with a first preferred embodiment, the pneumatic actuator comprises a first external cylinder and at least one second internal cylinder wherein the drive piston slides, said internal cylinder telescopically sliding in respect to the external one; each of said external and internal cylinders comprising a tubular body and closure end heads wherein inlet/outlet passages for feeding and discharging pressurized air are provided; the tubular body of the internal cylinder comprising an extruded tubular section having at least one longitudinal conduit for the air flow provided in at least one side wall.

With a telescopic actuator according to the invention, in the contracted condition it is therefore possible to reduce the overall length dimensions considerably while maintaining the same stroke in relation to a conventional cylinder, or increase it by maintaining in any case the overall cross and longitudinal dimensions of the actuator in its retracted condition small. For example, with the same useful working stroke, a two stage telescopic actuator according to the invention allows for a length reduction equal to at least 15–20% compared to a conventional pneumatic cylinder, which can even be greater in percentage terms for telescopic cylinders having several stages.

According to another embodiment, the pneumatic actuator consists of a single double-acting cylinder, wherein the pressurized air is fed at both sides of the piston chamber, from one single end of the cylinder, for example from the closure head which is opposite to the closure head from which the piston rod slides out, by conduit means into the side wall of the tubular body during the extrusion of the same.

BRIEF DESCRIPTION OF THE DRAWINGS

Some preferred embodiments of double-acting pneumatic actuators according to the invention, will be described in greater detail hereinbelow with reference to the figures of the accompanying drawings, in which.

DETAILED DESCRIPTION OF THE INVENTION

With reference to the drawings, in particular to FIGS. 1 to 4, we will first describe the general features of a double-acting telescopic pneumatic actuator, according to a first embodiment of the invention.

Figure 1:
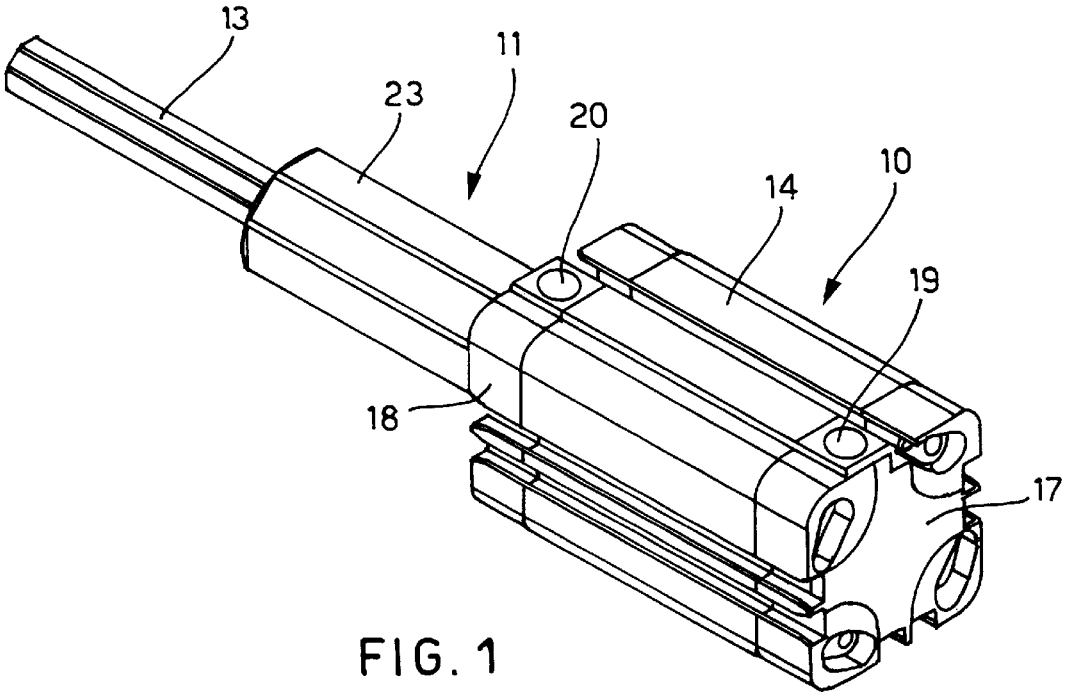
FIG. 1 is a perspective view of a telescopic actuator in an extended condition.

As can be seen in FIG. 1, the assembly of the telescopic actuator substantially comprises a first or external pneumatic cylinder 10 of the double-acting type, wherein a second or internal double-acting pneumatic cylinder 11 telescopically slides.

More particularly, the external cylinder 10 comprises a tubular body 14 formed by an extruded section in aluminium, which defines a piston chamber 15 extending along a longitudinal axis. Inside the chamber 15 a piston 16 slides, forming the internal closure head of the second cylinder 11.

The chamber 15 of the external cylinder is closed at both ends by respective closure heads 17, 18, each provided with port 19 and 20 for the passage of the pressurized air which must be alternately fed into and discharged from the two sides of the piston chamber 15. Finally, reference 22 in FIGS. 3 and 4 denotes a bush forming part of the closure head 18 of the external cylinder, for the guiding of the internal cylinder 11, as shown.

The internal cylinder 11 in turn comprises a tubular body 23 provided again by an extruded section in aluminium, defining a piston chamber 24 wherein a piston 12 slides; the piston 12 is provided with a drive rod 13 slidingly extending from one end of the same cylinder.

Figure 4:
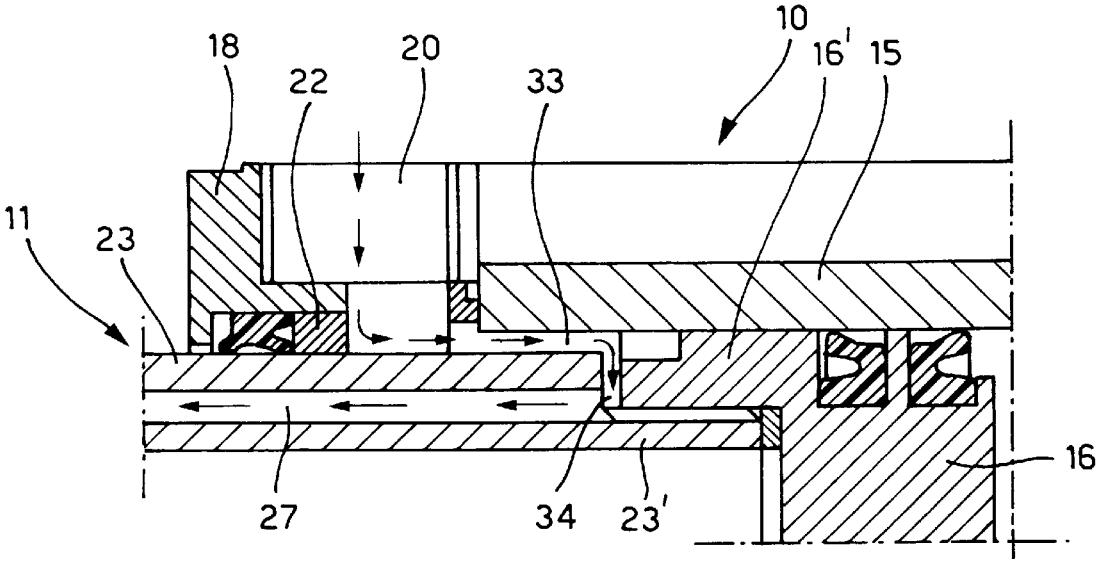
FIG. 4 is an enlarged detail of FIG. 3, designed to illustrate the air path between the first and second stage of the telescopic actuator of FIG. 1.
Figure 2:
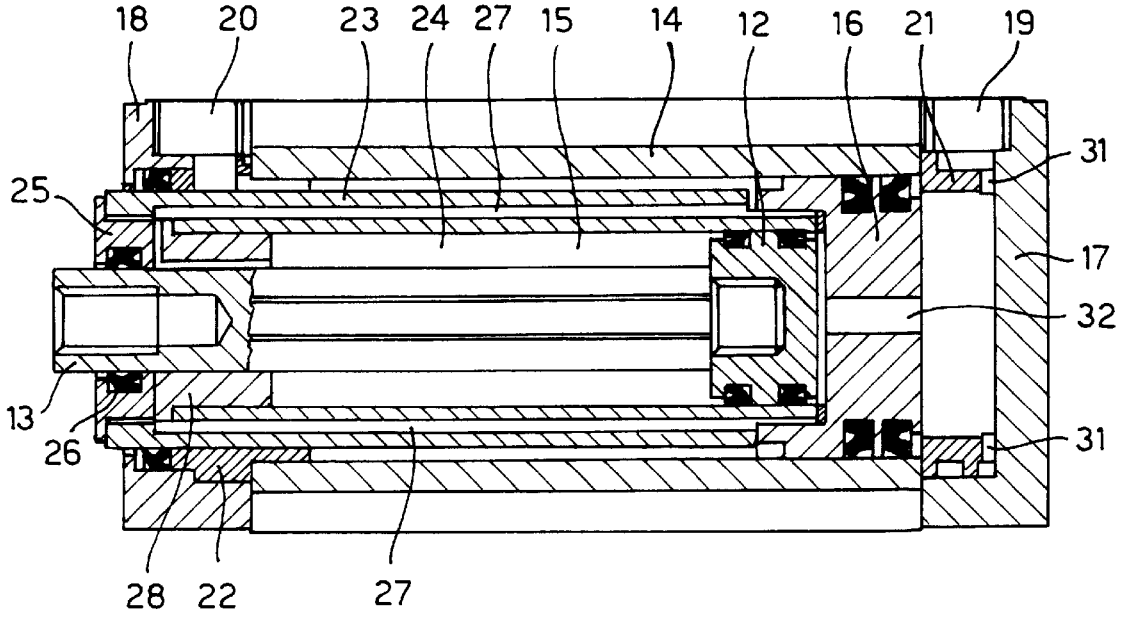
FIG. 2 is a longitudinal sectional view of the actuator of FIG. 1, in a contracted condition.

The chamber 24 of the internal cylinder is in turn closed at both ends by respective closure heads, one of which is defined by the same piston 16 of the external cylinder; to this purpose the piston 16, on one side, is provided with a cylindrical wall 16' wherein the threaded end 23' of the body 23 of the internal cylinder 11 is screwed, as shown in FIG. 4.

The other closure head 25 of the internal cylinder is in turn screwed into a corresponding threaded seating at the other end of the body 23 of the second cylinder 11. It also has an axial hole with sealing 26 for the passage of the drive rod 13.

According to the present invention, the tubular bodies 14, 23 of the external cylinder 10 and of the internal cylinder 11 are formed by extruded sections, in aluminium, with the required shape and profile, and which require simple mechanical operations for the attachment of the closure heads and for the formation of the air passages, which do not require additional parts.

In particular, as regards the internal cylinder 11, the tubular body 23 is obtained by simple extrusion, directly with the longitudinal channels 27 formed in its peripheral wall and which therefore can be used for flowing pressurized air from the port 20 in the closure head 18 of the external cylinder, towards the opposite end of the piston chamber 24, as explained further on.

In particular, the use of a tubular body for the internal cylinder, directly extruded with the conduits 27 for conveying the air, allows the advantage of providing telescopic cylinders of any shape and size, or of any length, in that the conduits 27 for the air flow are formed directly during the extrusion of the same tubular body. This allows the conduits 27 to be longitudinally extended into the wall of the tubular body, irrespective of the length of the cylinder, without performing mechanical operations of drilling, which would be difficult to be perform unless special equipment is used, and which in any case can be performed for extremely limited lengths, given the impossibility of making conduits 27 mechanically for considerable lengths in walls of extremely limited thickness.

The use of a section for the body 23 of the internal cylinder, extruded directly with the conduits 27 for the pressurized air, allows a further advantage which consists in the possibility of connecting the body 23 of the internal cylinder to the piston 16 for the external cylinder by simple screwing. This can be achieved by forming a cylindrical end portion 23' by means of a simple mechanical operation, partially removing the material from one end of the original section 23, which cylindrical end 23' can be threaded in order to be screwed into the cylindrical wall 16' of the piston 16, as shown in FIG. 4.

The mechanical action of removing the material for forming the threaded end 23' of the body 23 also leaves the conduits 27 for conveying air open, without requiring further additional processing.

The above also applies for the formation of the threaded seating for screwing the head 25 at the other end of the body 23 of the internal cylinder 11.

Figure 3:
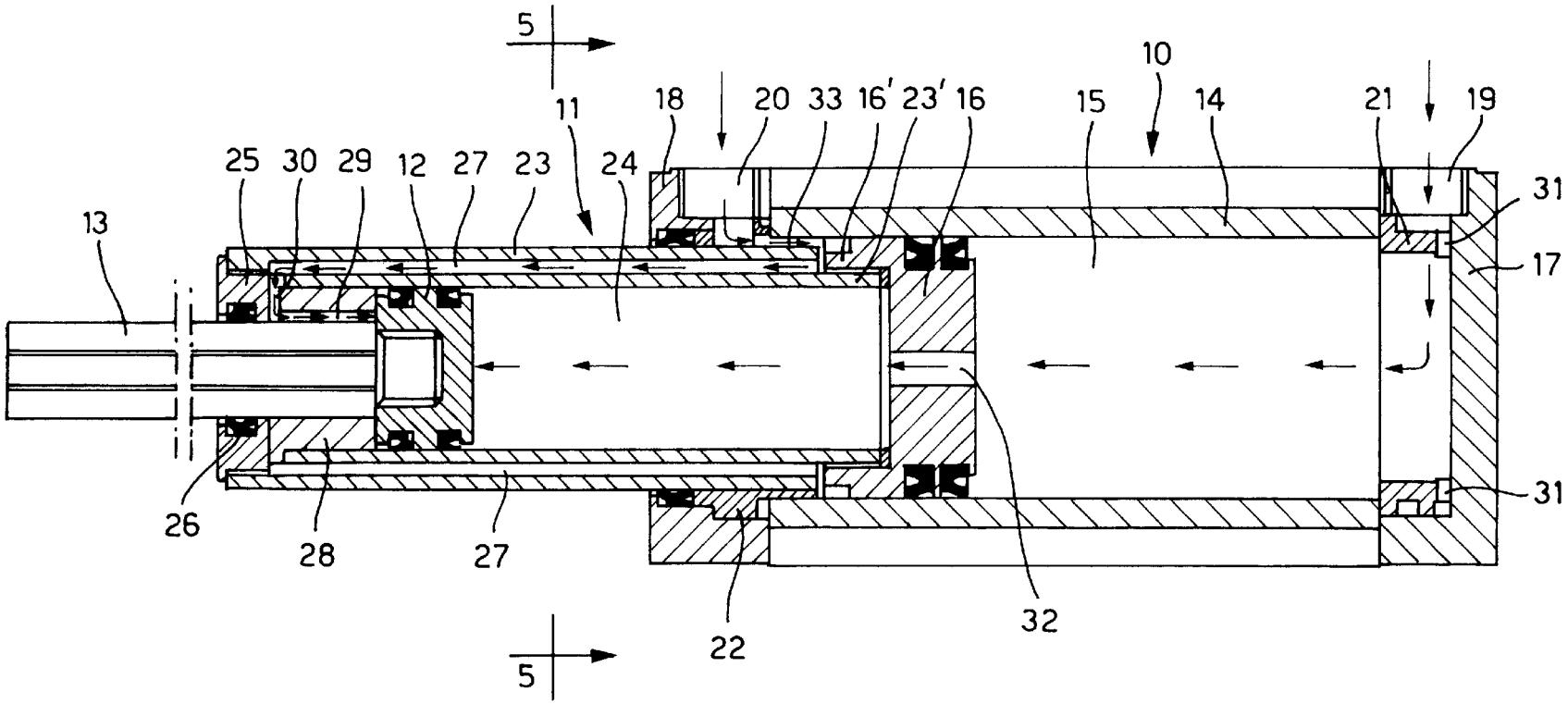
FIG. 3 is a longitudinal sectional view of the telescopic actuator of FIG. 1, again in an extended condition.

Finally 28 in FIG. 3 denotes an internal guide bush for the rod 13 of the internal cylinder. The bush 28 is formed with at least one longitudinal groove 29 which on one side communicates with a conduit 27 through a radial hole 30, and on the other side opens towards the chamber 24 of the internal cylinder 11.

As previously referred to, the holes 19, 20 in the two closure heads 17, 18 of the external cylinder are alternately used for feeding and discharging pressurized air on both sides of the two chambers 15 and 24 of the two cylinders.

In particular, as shown in FIG. 3 the port 19 communicates with one side of the chamber 15 through radial holes 31 in the spacer 21. In turn the chamber 15 of the external cylinder communicates on one side of the chamber 24 of the internal cylinder through an axial hole 32 in the piston 16 also forming the internal head or the rear closure wall of the chamber 24 of the cylinder 11.

Contrarily, as shown in FIGS. 3 and 4 the second port 20 in the closure head 18 communicates with the front side of the piston chamber 15 of the external cylinder, that is on the opposite side of the piston 16, through a slot 33 in the guide bush 22 for the internal cylinder, and communicates respectively with the front side of the piston chamber 24 of the internal cylinder, through one or more longitudinal conduits 27 into the wall of the second cylinder, and through an annular groove 34 formed between opposite surfaces at the machined end of the body 23 of the internal cylinder and of the piston 16, as shown in FIG. 4.

A further advantage in the use of an extruded section in aluminium for the tubular body 23 of the internal cylinder can be appreciated with reference to FIGS. 5 to 9 which show different cross sectional views along line 5—5 of FIG. 3, wherein the same reference numerals have been used to denote similar or equivalent parts.

From the aforementioned Figures it can be noted in particular that the external and internal peripheral profile of the tubular body 23 of the cylinder 11 can differ in each case, being changed by the same extrusion operation to adapt to special needs.

Figure 5:
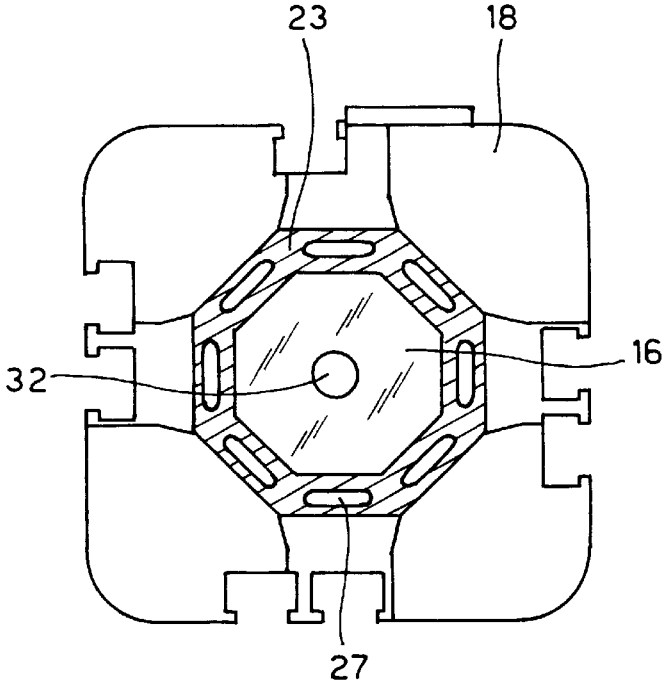
FIGS. 5, 6, 7, 8 and 9 show different cross sectional views along line 5—5 of FIG. 3, designed to illustrate different extrusion profiles of the tubular body of the internal cylinder of the telescopic actuator of FIG. 1.

In particular in FIG. 5 the tubular body 23 of the internal cylinder 11 has an external and an internal polygonal profile, for example of octagonal type, such as to confer features of anti-rotation both for the internal cylinder itself and for the drive rod 13, in relation to the external cylinder 10.

In the case of FIG. 6, the body 23 has again an external polygonal profile combined with an internal cylindrical profile in a similar manner to the piston 12 and to the rod 13. This can be useful for example when the rod 13 has to be free to rotate around its own longitudinal axis.

Figure 6:
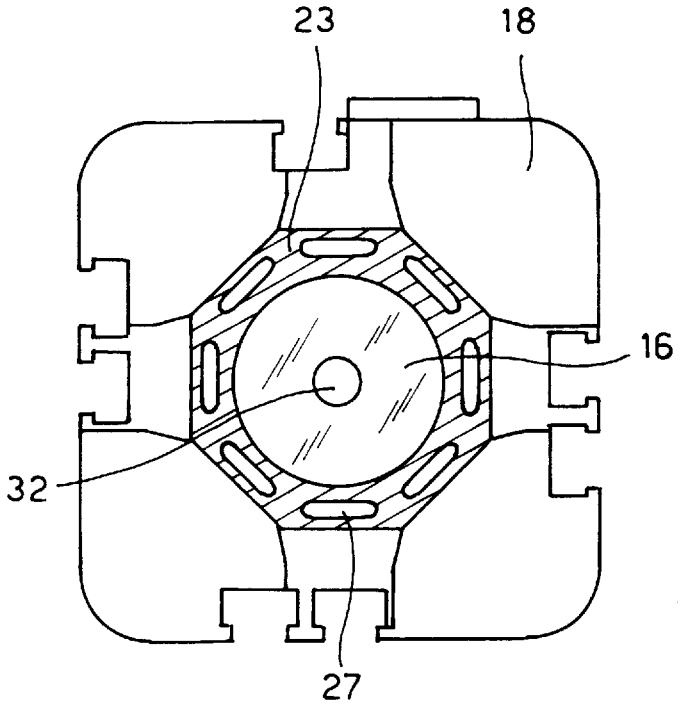
Figure 7:
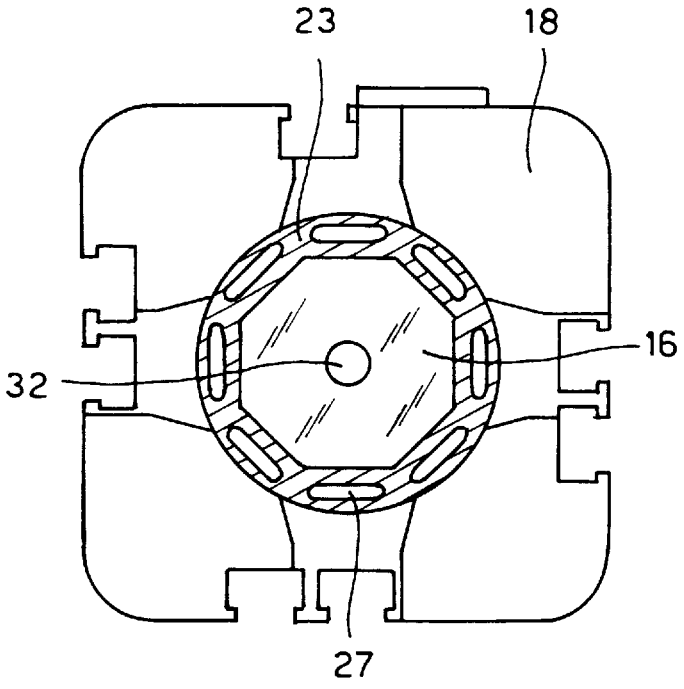

In the example of FIG. 7 there is a reverse situation in relation to FIG. 6, that is to say the body 23 of the internal cylinder 11 has an internal polygonal profile and an external cylindrical profile.

Figure 8:
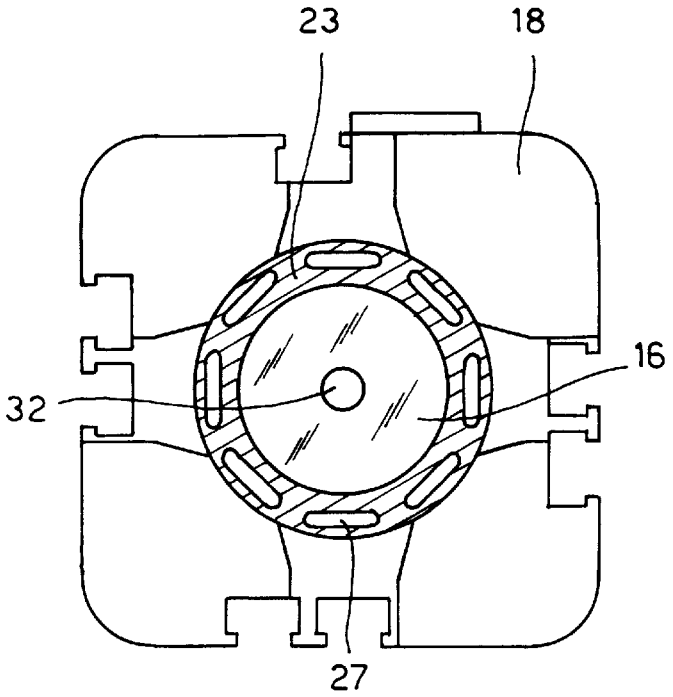

FIG. 8 shows a fourth solution wherein the body 23 of the cylinder 11 has a circular profile both for the external and the internal surfaces.

Figure 9:
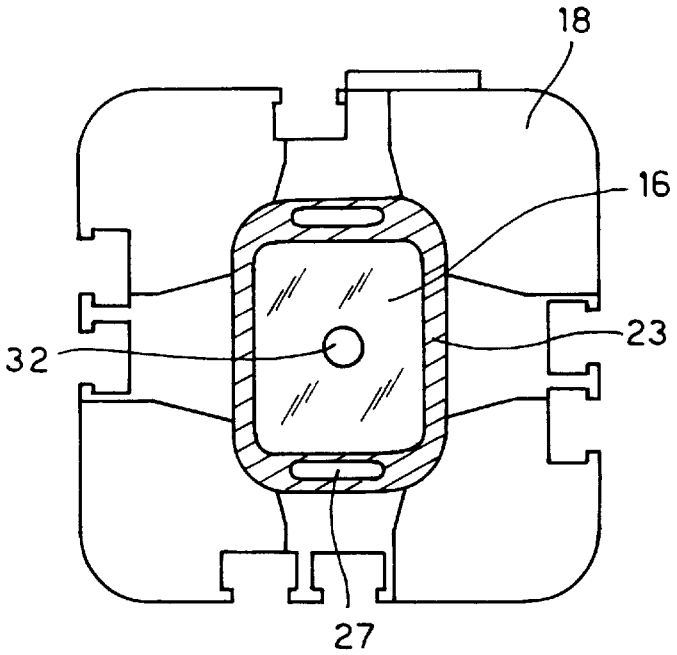

FIG. 9 shows a fifth solution wherein the tubular body 23 of the internal cylinder has a substantially rectangular profile with strongly rounded corners, or an ovalised profile to adapt to different dimensional requirements or for specific uses.

Figure 10:
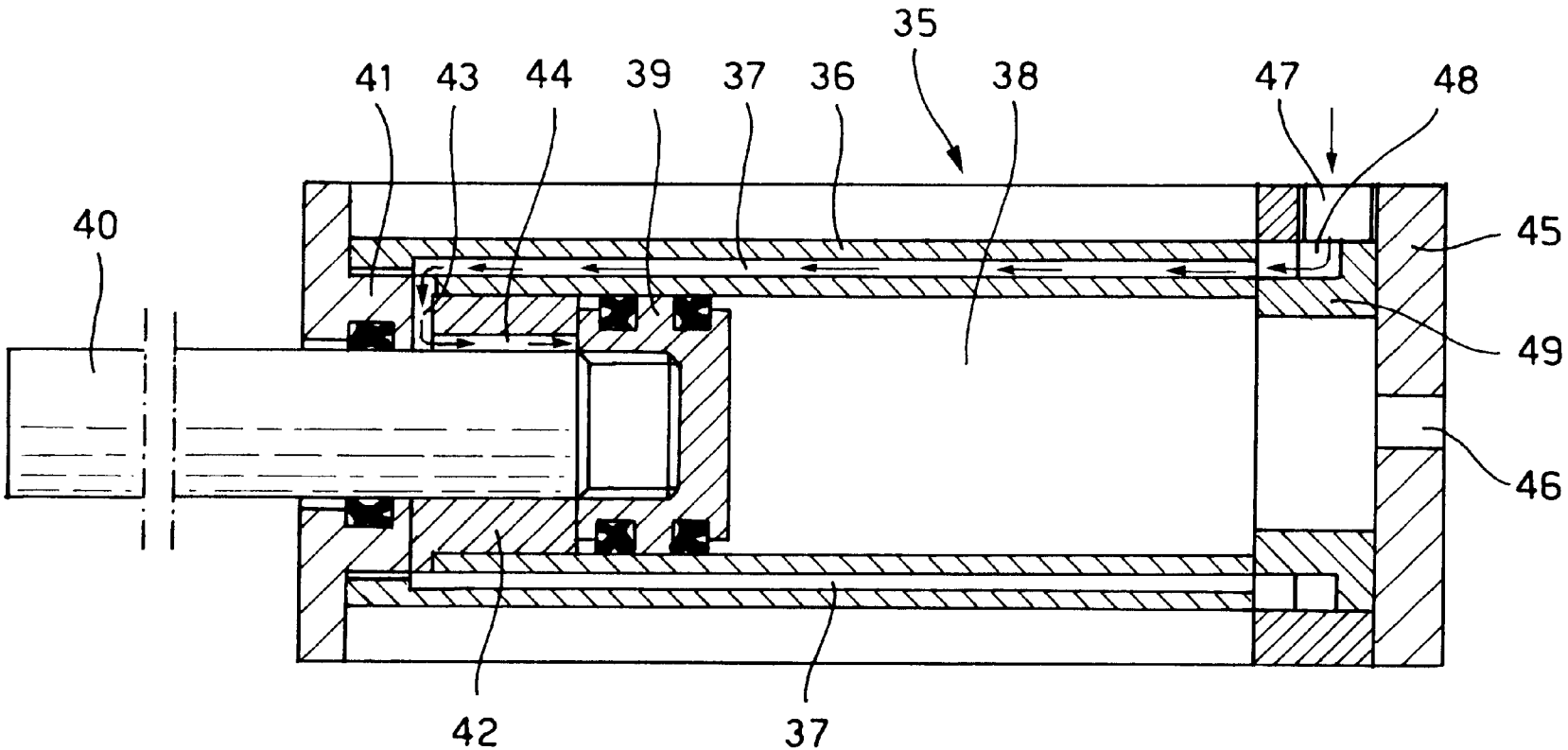
FIG. 10 is a longitudinal sectional view of a double-acting cylinder according to the invention.

FIG. 10 shows a second solution of a pneumatic actuator according to the invention, formed by a single double-acting cylinder, wherein the pressurised air can be fed selectively to the two ends of the piston chamber by one single side, for example from the rear head which is opposite the front head through which the rod of the piston slides out.

In the case of FIG. 10, the cylinder 35 again comprises a tubular body 36 formed by a section in aluminium which is extruded directly with the conduits 37 for the flow of pressurized air, in one or more of its side walls.

Reference 38 in FIG. 10 also denotes the pneumatic chamber for the piston 39, while reference 40 denotes the usual rod of the piston 39, which tightly projects from the front head 41.

Reference 42 likewise denotes a bush for guiding the rod 40 wherein the passages 43 and 44 for the pressurized air have been formed, to connect one or more of longitudinal conduits 37 to one side of the piston chamber 38.

The rear end of the chamber 38 is however closed by a head 45 provided with a central hole 46 for the direct feeding and discharging of the pressurized air from one side of the chamber 38, as well as with a side port 47 which communicates with the longitudinal conduits 37 via in a circular groove 48 of a ring member 49 inside the same closure head 45.

In this case too the profiles of the extruded body 36 of the cylinder may be of any polygonal and/or circular type as described previously for FIGS. 5 to 9 in relation to the telescopic actuator of FIG. 1.

From what has been said and shown in the accompanying drawings it is therefore clear that a double-acting pneumatic actuator has been provided, which may be in the form of a single traditional cylinder, a cartridge cylinder or a cylinder with one or more sections which can be lengthened telescopically, whereby an extremely simple and advantageous embodiment is allowed for the use of one or more conduits for conveying air, made directly by extrusion with the body itself. Moreover the use of sections extruded with the air flow conduits likewise allows lightening and extreme constructional simplification of the actuator as manufactured.

The intent therefore is that what has been said and shown with reference to the accompanying drawings has been given purely by way of an example and that other modifications or variants may be made, without thereby departing from the present invention.

What is claimed is:

1. A pneumatic actuator comprising:

an external pneumatic cylinder comprising an extruded tubular body, said extruded tubular body defining a first piston chamber;

at least one internal pneumatic cylinder located coaxially internal to and telescopically extendable from said external cylinder and comprising an extruded tubular body with a longitudinally extruded conduit and defining a second piston chamber, each end of said extruded tubular body of said internal cylinder having two axially spaced parallel end surfaces;

a first external closure head closing a first base end of said external cylinder and a second external closure head slidably accepting said internal cylinder and closing a second opposite end of said external cylinder;

a first inlet/outlet air port in said first external closure head arranged to admit and discharge air into and from said first piston chamber;

a second inlet/outlet air port in said second external closure head arranged to admit and discharge air into and from said conduit; and a first piston slidable internal to said first piston chamber and forming a first closure head at a first end of said internal cylinder facing the first external closure head by sealingly contacting a first of the two parallel end surfaces of the first end and being spaced apart from a second of the two parallel end surfaces of the first end so as to provide a spaced air passage from said second inlet/outlet air port to said conduit.

2. Actuator according to claim 1 wherein the tubular body of the internal cylinder is provided with identical internal and external profiles of polygonal shape.

3. Actuator according to claim 1 wherein the tubular body of the internal cylinder is provided with an external polygonal profile and an internal circular profile.

4. Actuator according to claim 1 wherein the tubular body of the internal cylinder is provided with an external circular profile and an internal polygonal profile.

5. Actuator according to claim 1 wherein the tubular body of the internal cylinder is provided with an internal and an external profile of a circular shape.

6. Actuator according to claim 1 wherein the tubular body of the internal cylinder is provided with an external and an internal profile of a rectangular or ovalised shape.

7. Actuator according to claim 1, wherein the tubular body of the internal cylinder is provided with an external and an internal profiles of a ovalized shape.

8. The pneumatic actuator of claim 1, further comprising:

a bush located intermediate said second external closure head and said internal cylinder, said bush having an bush air passage aligned with said second inlet/outlet air port and said spaced air passage.

9. The pneumatic actuator of claim 8, wherein said first piston is threaded on the end of said internal cylinder.

10. The pneumatic actuator of claim 1, further comprising:

a second closure head contacting a first of the two parallel end surfaces of a second end of said internal cylinder and being spaced apart from a second of the two parallel end surfaces of the second end so as to provide a spaced air passage aligned with said conduit.

11. The pneumatic actuator of claim 10, further comprising:

a second piston internal to said internal cylinder; and an internal guide bush located at and internal to the second end of said internal cylinder; and an internal air passage within said internal guide bush arranged to provide an air passageway for air to act against said second piston by air passing via said conduit, to and through said spaced air passage aligned with said conduit, and then to and through said internal air passage.

12. The pneumatic actuator of claim 1, wherein said extruded tubular body of said internal cylinder comprises plural longitudinally extruded conduits angularly spaced apart.

* * * * *